United States Patent [19]

Kaneko et al.

[11] Patent Number: 4,968,573

[45] Date of Patent: Nov. 6, 1990

[54] METHOD OF DEVELOPING ELECTROSTATIC LATENT IMAGES

[75] Inventors: Tadashi Kaneko; Yuki Okuyama; Mitsutaka Arai; Yoko Yamamoto; Satoru Ikeuchi, all of Hachioji, Japan

[73] Assignee: Konishiroku Photo Industry Co., Ltd., Japan

[21] Appl. No.: 942,389

[22] Filed: Dec. 16, 1986

[30] Foreign Application Priority Data

Dec. 17, 1985 [JP] Japan ..... 60-285079
Jun. 13, 1986 [JP] Japan ..... 61-137764

[51] Int. Cl.[5] ..... G03G 9/083
[52] U.S. Cl. ..... 430/106.6; 430/122
[58] Field of Search ..... 430/106.6, 107, 108, 430/111, 122

[56] References Cited

U.S. PATENT DOCUMENTS 4,600,675 7/1986 Iwasa ..... 430/106.6
4,623,603 11/1986 Iimura et al. ..... 430/106.6
4,629,673 12/1986 Osawa et al. ..... 430/106.6
4,640,880 2/1987 Kawanishi et al. ..... 430/106.6

FOREIGN PATENT DOCUMENTS 91654 10/1983 European Pat. Off. .
142731 5/1985 European Pat. Off. .
A2075209 11/1981 United Kingdom .

*Primary Examiner*—John L. Goodrow
*Attorney, Agent, or Firm*—Jordan B. Bierman

[57] ABSTRACT

In a method of developing an electrostatic latent image formed on an electrostatic latent image-carrying member with a developer comprising a magnetic carrier and a toner in a non-contact manner under application of an oscillating electric field to a development region, the improvement comprising the surface of said magnetic carrier is covered with an insulating material, and magnetization (M) of said magnetic carrier when measured under application of a magnetic field of 1000 Oersted and weight average diameter (R) of the same expressed in terms of micro meter satisfy the following relation:

$$30 \leqq M \leqq -0.8\,R + 150$$

(wherein $10 \leqq R \leqq 150$).

20 Claims, 2 Drawing Sheets

METHOD OF DEVELOPING ELECTROSTATIC LATENT IMAGES

TECHNICAL FIELD OF THE INVENTION

The present invention relates to a method of developing electrostatic latent images.

BACKGROUND OF THE INVENTION

An electrophotographic method has been utilized widely which supplies an area to be developed with toner by forming a magnetic brush with magnetic carriers along the magnetic lines of force of magnet installed in a developing sleeve to develop electrostatic latent images using 2-component developer that consists of toner and magnetic carrier.

For the typical contact development, developing characteristics depend significantly on conditions of the formed magnetic brush. Strong magnetic force acting among magnetic carriers causes a "hard" magnetic brush to be formed. Thus, toner already used for development is subjected to force produced by the magnetic brush and is moved, degrading toner quality and making it impossible to provide correct electrostatic. latent images. In consequence, black images may be scratched by the magnetic brush and fine lines may get dull, resulting in lowered resolution. To eliminate such defect, a method of forming a "soft" magnetic brush using a magnetic distributed carrier (hereinafter called the "distributed carrier") to reduce the scratching force has been proposed. The distributed carrier consists of particles with a particle diameter of 30 micrometers obtained by kneading magnetic grains such as magnetite with resin and crushing them.

The distributed carrier, however, may not be formed in a definite shape and its surface tends to be rough. So, the fluidity of developer consisting of carrier and toner becomes low, leading to the carrier not mixed with the toner sufficiently and preventing frictional chargeability of the developer. Further, since the magnetic particles tend to be exposed on the surface, it prevents the frictional chargeability of the surface of the carrier particles from being active through their friction. This causes such troubles as the toner cannot sufficiently electrified, resulting in troubles such as toner scattering and fogs. In addition, iron powder and magnetite particles used widely as magnetic material have low electric resistance; so, distribution of these materials in the resin often results in insufficient insulation of carrier particles, resulting in insufficient electrification of the toner, and development by the carrier particles themselves (i.e., carrier adhesion) due to charges induced by electrostatic latent images.

On the other hand, a process which keeps an electrostatic image-carrying member and the developer layer separate from each other and applies an AC field for development requires a thin, uniform, short-turfed developer layer to be formed. FIG. 2 shows a model of the non-contact developing process, wherein 1 denotes the latent image-carrying member, 2 denotes the developer, 3 denotes a developing sleeve, 4 denotes a magnet roller, 5 denotes an AC power source (2 kHz, 1 kVp-p), 6 denotes a DC power source (200 V), 7 denotes an agitating blade, and 8 denotes a regulating blade.

Unlike the contact development, in the non-contact development, toner already used for development is not scratched through friction with the magnetic brush. Thus, the non-contact development has the capability to provide high-quality latent images. Further, on the toner image already formed by development, different-color toner can easily be superimposed. So, the non-contact development method can advantageously be applied to color development. In particular, for the two-component, non-contact development, as the toner contains no magnetic particles such as iron grains and magnetite, clear color image can be obtained.

Obtaining high-resolution images in the non-contact development requires a developing gap (distance between carrying member and sleeve 3) to be maintained to 1 mm or less and a developer layer having a thickness of 1 mm or less to be formed. Further, as a less amount of developer passes through the developing area, a very dense developer layer must be formed to get high image density.

Forming a dense developer layer requires enhancing toner fluidity to increase toner density on the developing sleeve and making the toner more live. But such requirements have not been discussed fully.

Besides, during inversion for making toner adhere onto an exposed portion, carriers tend to adhere onto a non-exposed portion, resulting in production of fogs.

A Japanese Patent O.P.I. Publication No. 59-154469, discloses magnetic toner as developer for non-contact, inverting development. The magnetic toner comprises polystyrene-system resin and magnetic particles such as magnetite distributed therein. (The magnetic toner shall be hereinafter called a distributed carrier.) Use of such distributed carrier, however, limits the content of magnetic material in the carrier to no more than 80 weight percent. So, it is difficult to produce carriers having high magnetic force. Thus, magnetic force operating on the magnet roller arranged in the developing sleeve does not grow sufficiently high, which makes it impossible to prevent the carrier from adhering onto the non-exposed portion. In the reversal development, as described later on the basis of FIG. 7, the potential of the non-exposed portion is negative with respect to a developing bias. Therefore, the positive carrier particles tend to be attracted by the negative field, adhering onto the non-exposed portion.

Part of the distributed carrier particles that have adhered on the non-exposed portion appear on a duplicated picture as fogs.

FIG. 5 shows a sample model of surface potential of a latent image-carrying member (photoconductive material with an photoconductive layer consisting of organic optical conductors (OPC)) appearing when electrostatic latent images are formed by subjecting the latent image-carrying member to laser beams. Prior to being subjected to laser beams, the latent image-carrying member has been charged in −700 volts by a charger.

The surface potential of the non-exposed portion DA not subjected to laser beams is kept at −700 volts, while the surface potential of the exposed portion PH subjected to laser beams is −100 volts.

For reversal development, toner T charged negatively is caused to adhere onto the exposed portion PH with a developing bias of −600 volts applied. The surface potential of the latent image-carrying member is as shown in FIG. 7. As the toner T is charged by its friction with carrier particles, the toner T negatively charged causes the carrier particles to be charged positively. As described above, since the magnetic force of the carrier C is not sufficiently high, it is released from the developing sleeve, adhering onto the non-exposed portion DA.

Preventing this adhesion requires increasing sufficiently force of magnetically restraining the carrier on the sleeve. For this, carrier particles are made to be larger to increase such force operating on them. Larger carrier particles, however, result in a rough magnetic brush on the sleeve and higher turfs, which come in contact with the latent image-carrying member. Thus, contrary to expectation, more carrier particles tend to adhere onto the non-exposed portion DA.

Further, larger carrier particles prevent toner concentration from being increased sufficiently. For example, use of a distributed carrier whose particle diameter is about 20 micro-meters results in no toner being scattered, even though the toner concentration is 10 to 30 weight percent. With increase of particle diameter, however, the carrier surface area is decreased. e.g., for a particle diameter of 80 micrometers, the upper limit of tonre concentration is about 10 weight percent. In that case, as sufficient toner is not supplied to the developing area, sufficient image concentration may not be obtained.

Besides, for the distributed carrier, magnetic particles are likely to present on the surfaces of carrier particles; so, its electric resistance cannot be increased sufficiently. If a carrier whose resistance value is not sufficiently high is used, charges having the polarity reverse to that of charges produced on the latent image-carrying member are induced on carrier particles by electrostatic induction, and such carrier particles are inclined to adhere onto the exposed portion PH (see FIG. 7) of tahe latent image-carrying member along with the toner. As the carrier particles are larger than the toner particles, the applied carrier particles lower the resolution. For color development, the developed color may get turbid due to adhesion of black and/or brown carrier particles as well as color toner. This is a critical disadvantage.

This phenomena tends to appear in non-contact development wherein an AC bias applies periodic high bias voltage.

As the diameters of the distributed carrier particles range from 10 to 30 micro-meters, the carrier fluidity is low. So, the fluidity of the developer consisting of the carrier and toner is also lowered. In consequence, carrier particles and toner are not frictionally charged fully, resulting in toner scattering, fogs and/or rough images.

SUMMARY OF THE INVENTION

An object of the present invention is to provide a developing method for forming a short-turfed, dense developer layer well adapted to non-contact developments to obtain high-equality images in either normal or reversal development.

An another object of the invention is provide an improved developing method, in which chargeability and fluidity of toner and durability and insulating properties are improved, and falling off of magnetic particles from the developing sleeve is effectively prevented.

The present invention relates to an improved method of developing electrostatic latent images on a latent image-carrying member with a developer comprising a carrier and a toner in a non-contact manner under application of an oscillating electric field to a development region, wherein said development is carried out by the use of a magnetic carrier of which surface is covered with an insulating material, and magnetization(M) of said carrier when measured under application of a magnetic field of 1000 Oersted and average weight diameter(R) of the same expressed in terms of micro meter satisfy the following relation:

$$30 \leqq M \leqq -0.8R + 150$$

(wherein $10 \leqq R \leqq 150$)

BRIEF DESCRIPTION OF THE DRAWINGS

FIG. 1 is an expanded cross sectional view of a coating carrier;

FIG. 2 is an expanded cross sectional view of a developing device;

FIG. 3 is a graph which represents a relation of the fed developer amount to the gap between a developer regulating blade and a developer transporting member (sleeve);

FIG. 4 is an expanded cross sectional view of a latent image-carrying member;

FIG. 5 is a graph which represents sample surface potential of the latent image-carrying member produced by exposure to light;

FIG. 6 is a graph which represents the surface potential of the latent image-carrying member and toner adhesion in reversal development.

DETAILED DESCRIPTION OF THE INVENTION

Figure 1:
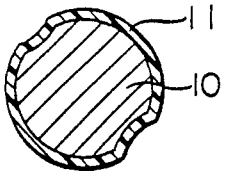
FIGS. 1 thru 6 illustrate preferred embodiments of the present invention.

As described above, in the non-contact development that applies an alternating electric field, less gap between the latent image-carrying member (photoconductive material) and a developing sleeve provides better developing properties and higher-resolution images. It is desirable that the gap size is not more than 1 mm, preferably 0.3 to 0.7 mm. Keeping the developer and the photoconductive material separate from each other under this condition, however has turned out to be impossible with a developer containing carrier particles with the same particle diameters and magnetization as those used in the typical contact, 2-component development. But it has been proven that a carrier which meets the above expressions and has on its surface an insulated coating layer provides excellent results. That is, it has been found that if M and R are selected to meet the above relation, the developer layer on the developing sleeve has shorter turfs, which has been found to be advantageous in the non-contact development. On the contrary, if M is less than 30, a required developer layer may not be formed due to too weak magnetization, and if M exceeds (−0.8 R+150), such developer is not suitable for non-contact development due to too strong magnetization. The diameter (R) of a carrier particle is also an important factor. If R is less than 10, the magnetic binding force of carrier particles is weak, so that stable developer layer may not be formed. If on the other hand, R is more than 150, the developer layer becomes too sparse, which results in poor images upon development, or the degree of magnetization is insufficient and a stable developer layer may not be obtained.

In the present invention R is defined to be weight average particle diameter. It is preferable that R is 20 to 60 micro-meters. Further, it is preferable that the strength of magnetization is 40 to 100 emu/cm$^3$.

As for the core material of the carrier particle of the present invention, iron powder, nickel powder, cobalt powder, magnetite powder or ferrite powder may be used. The term, "ferrite", which refers to the general magnetic oxides in the present invention is not limited to spinel ferrite that can be expressed by $MO \cdot Fe_2O_3$ (M is divalent metal). The ferrite, as various magnetic characteristics can be obtained by changing its metal components, provides carriers well adpated to the purposes of the present invention.

Further, the ferrite, which is an oxide, is lighter than iron powder, nickel powder, etc. So, it can be mixed and agitated with toner with ease, permitting uniform toner concentration and charges. Besides, the ferrite has higher electric resistance ($10^8$ to $10^{12}$ ohms-cm) than iron powder, nickel powder, cobalt powder, etc. Thus, the ferrite has an advantage that, even when an insulating resin coating layer is made as thin (as 0.5 micrometers, insulated carrier particles well adapted to a development in which a high bias field is applied to the developing gap can be obtained.

To get the resistance value, ferrite particles are put into a vessel having a cross section of 0.50 cm$^2$, a load of 1 kg/cm$^2$ including an electrode is applied against the particles, and the current value is read by applying the voltage producing an electric field of 1,000 volts/cm between the above electrode and a bottom electrode.

The weight average particle diameter has been measured using a Coulter counter manufactured by Coulter Corporation.

As the ferrite alone has an electric resistance of no more than $10^{12}$ ohms-cm, charges may be induced over the whole carrier particle under the presence of an alternating field. To enhance its insulating properties, as shown in FIG. 1, the core material 10 is coated with an insulating resin 11 in accordance with the present invention for stable development of either normal and reversal process.

The coating resin to be used includes styrene-acrylic resin, silicon resin, fluororesin, acrylic resin, polyester resin, epoxy resin, vinyl chloride-vinyl acetate polymer, and nitrogen-containing resin. Besides the resin, inorganic insulating materials such as glass and ceramics may also be used.

For layer forming a resin that is soluble into solvent and can be spray-coated or impregnation-treated by solution for is usually used. It is preferable that the thickness of the coating layer 0.1 to 10 micro-meters, preferably 0.3 to 3 micro-meters to obtain sufficient insulating properties and stable characteristics.

The carrier particle diameter and the degree of magnetization depends considerably on carrier density on the developing sleeve. Generally speaking, the smaller the particle diameter and the lower the magnetization strength, the higher the effect. However, when the carrier particle diameter is too small and the degree of magnetization is too low, the magnetic binding force onto the developing sleeve becomes insufficient, resulting in carrier particles being scattered and/or carrier particles adhering onto images. To prevent this, it is preferable that the carrier particle diameter is made not less than 20 micro-meters and the strength of magnetization not lower than 40 emu/cm$^3$.

For implementation of the present invention, an oscillating bias such as AC bias as the developing bias is applied to vibrate toner particles for their fly onto the latent image-carrying member. In this case it is preferable that DC bias is also applied to prevent fogs from being produced. It is preferable that AC bias to be applied is 0.2 to 3.0 kV at frequencies of 100 Hz to 10 kHz, preferably 0.2 to 3.0 kHz. It is advisable that DC bias of 50 to 500 volts is also applied for the purpose of maintaining potential higher than that of a non-image section.

The carrier used for the present invention makes up a 2-component developer along with any toner. The preferable toner is such that polyester resin or styrene-acrylic resin is used as the binder.

The polyester resin may be prepared by condensation of alcohol and carboxylic acid. The alcohol to be used includes, for example, ethylene glycol, diethylene glycol, triethylene glycol, 1,2-propylene glycol, 1,3-propylene glycol, 1,4-butane diol, neopentyl glycol, diols such as 1,4-butane diol, 1,4-bis(hydroxymethyl)cyclohexane, a bisphenol A, a hydrogenated bisphenol A, a polyoxyethylene bisphenol A, an etherified bisphenol such as polyoxypropylene bisphenol A, and other dihydric alcohol monomer. The carboxylic acid includes, for example, fumaric acid, mesaconic acid, citraconic acid, itaconic acid, glutaconic acid, phthalic acid, isophthalic acid, terephthalic acid, succinic acid, adipic acid, sebacic acid, malonic acid and their anhydrides, dimer of lower alkyl ester and linolenic acid, and other dibasic organic acid monomer.

The polyester resin to be used in the present invention includes polymer based on the above bifunctional monomer, as well as polymer based on multi-functional monomer. Such polyhydric alcohol monomer includes, for example, sorbitol, 1,2,3,6-hexanetetrol, 1,4-sorbitan, pentaerythritol, dipentaerythritol, triphentaerythritol, sucrose, 1,2,4-butanetriol, 1,2,5-pentanetriol, glycerol, 2-methylpropanetriol, 2-methyl-1,2,4-propanetriol, trimethylolethane, trimethylolpropane, and 1,3,5-trihydroxy methylbenzene. The multifunctional carboxylic acid monomer includes, for example, 1,2,4-benzene tricarboxylic acid, 1,3,5-benzene tricarboxylic acid, 1,2,4-cyclohexane tricarboxylic acid, 2,5,7-naphthalene tricarboxylic acid, 1,2,4-naphthalene tricarboxylic acid, 1,2,4-butane tricarboxylic acid, 1,2,5-hexane-tricarboxylic acid, 1,3-dicarboxyl-2-methyl-2-methylenecarboxydipropane, tetra (methylenecarboxyl) methane, 1,2,7,8-octane-tetracarboxylic acid, and their anhydrides.

The above multi-functional monomer components contained preferably in a rate of 20 to 30 mol percent of the alcohol or acid constituents as the structural unit in polymer.

As the above styrene/acrylic resin, the resin which contains as the constituent unit alpha-beta unsaturated ethylene monomer disclosed by a Japanese Patent O.P.I Publication No. 50-134652, and whose weight-average molecular weight(Mw)/number-average molecular weight (Mn) is 3.5 to 40 may be used.

To manufacture the toner used for the present invention, a colorant (e.g., carbon black and/or nigrosine), and other additives, if necessary, may be mixed into said binder by, for example, a ball mill or the like, and then the mixture is kneaded, pulverized and classified. The toner particle diameter can be 1 to 50 micro-meters, and preferably 5 to 30 micro-meters.

The toner can also be obtained by other methods, e.g., spray drying, boundary condensation, suspension condensation, or solution condensation.

Presented below is a description of preferred embodiments of the present invention.

In development by 2-component developer, with no developing bias applied, the latent image-carrying member and the developer layer on the developer transporting member are preferably kept separate from each other and the toner is flown selectively onto the latent image portion of the latent image-carrying member under an oscillating electrical field generated by AC bias.

The developing method disclosed by the present invention, if the developer is constituted as described later, provides the capability to develop latent images with the gap between the latent image-carrying member and the developer transporting member kept small, by a thinner developer layer of 2,000 micro-meters or less, preferably 1,000 micro-meters or less, more preferably 10 to 500 micro-meters, further preferably 10 to 400 micro-meters, in a developing region (where the latent image-carrying member is situated opposite to the developer transporting member and where the transported toner is moved by electrostatic force onto the latent image-carrying member). According to the present invention, even though binding force between the carrier and the toner or that between carrier and developer transporting member is weak carrier particles can adhere fully on the developer transporting member (in most cases, a sleeve-like developer transporting member is used, so the developer transporting member is hereinafter referred to as "sleeve") and no carrier particle is scattered because the developer layer is made thin.

If the toner in the thin layer on the sleeve has been lost by development, developing properties are not affected adversely if enough toner is supplied to the thin layer. For this purpose, a magnet (i.e., magnet roller) incorporated in the sleeve should preferably be revolved in high speed.

In order to efficiently utilize the small amount of developer fed to the developing region it is preferable to take the following measures:

(1) use of a magnetic roller capable of revolving in high speed;
(2) application of an AC bias to the sleeve; and
(3) small gap between an image forming element and the sleeve.

In the non-contact development, if the developer layer is made thinner, such gap may be made smaller, and thus, the voltage of the developing bias to form the oscillating electric field can be lowered. Therefore, the toner can be prevented from being scattered, and leak discharge resulting from the developing bias from the sleeve surface can be suppressed. Further, a smaller gap between the latent image-carrying member and the sleeve permits increase of the strength of the electric field formed by the latent image in the developing region. As a result, images with fine tone and fine patterns can be developed well.

If the layer is made to be thinner, the amount of toner fed to the developing area is reduced, and thus, the amount of development is decreased. In order to increase the amount of the toner, it is effective that the sleeve revolves at high speed. If the ratio of the linear velocity of the latent image-carrying member to that of the sleeve is 1:10, the parallel velocity component of toner for use in development with respect to the latent image surface becomes great, resulting in uneven development in the direction along the movement of the latent image-carrying member and quality deterioration.

This tells that toner should adhere on the sleeve at a density of at least 0.04 mg/cm$^2$. Assuming that the linear velocity of the sleeve is Vs1, the amount of toner in the thin layer on the sleeve is mt, and the linear velocity of the latent image-carrying member is Vd, the following conditions must be met:

$$\left|\frac{Vse}{Vd}\right| \cdot mt \geqq 0.4\ [\mathrm{mg/cm^2}]$$

$$|Vse/Vd| \leqq 10$$

Allowing for developing efficiency, the above expressions can be rewritten as follows:

$$\left|\frac{Vse}{Vd}\right| \cdot mt \geqq 0.5\ [\mathrm{mg/cm^2}]$$

$$\left|\frac{Vse}{Vd}\right| \leqq 8$$

Further, allowing for experimental results, the following expressions can be introduced:

$$\left|\frac{Vse}{Vd}\right| \cdot mt \geqq 0.5\ [\mathrm{mg/cm^2}]$$

$$\left|\frac{Vse}{Vd}\right| \leqq 5$$

In the case, it is advisable that the ratio of the toner to carrier in terms of total projection area of toner to that of carrier in unit area is made to be about 0.5 to about 2.

Setting the above conditions permits efficient utilization of toner in the thin layer for development, leading to stable developing properties and excellent image quality.

The means for forming said thin developing layer include known elements such as a regulating blade consisting preferably of magnetic material arranged around the developer transporting member predetermined distance from it, and a magnetic roller which is located near the sleeve and regulates developer layer thickness by a rotating magnetic field.

In particular, a thin layer forming member consisting of pressure welded plates pressure-welded elastically against the sleeve can be used to eliminate dust, fiber chips and/or paper chips contained in developer, and/or impurities in toner or carrier.

The thin layer forming member, which consists of elastic plates pressed so that their tips face the upward direction of sleeve revolution, forms a thin layer by causing developer to pass between the sleeve and elastic plates.

Figure 3:
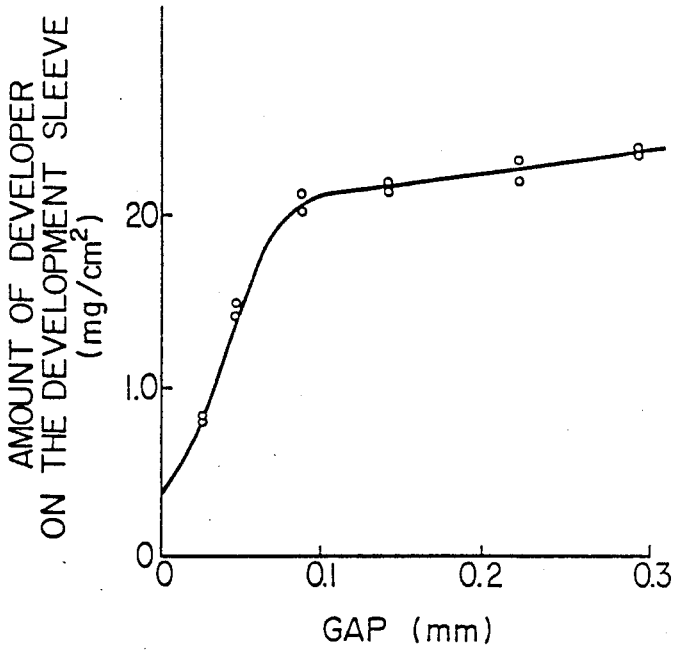

FIG. 3 illustrates a relation between the amount of developer adherent on the sleeve and the regulating blade tip to sleeve gap (opening area).

The Figure tells that, if the gap is more than a certain value, the amount of developer on the sleeve becomes stable. This stable condition permits feeding toner enough for development. Other experiment has shown that the layer thickness is varied little and other parameters affect little the establishment of the stable condition.

If the gap size is not less than 0.08 mm, a certain amount of toner can be fed stably in spite of installation accuracy and mechanical accuracy deviations. A gap size of 0.1 mm or more leads to further increased stability.

Of course, it is not desirable that the gap size is too great. If the gap size is not less than 5 mm, it was observed that eveness of the developer layer was no more maintained.

As described above, in the non-contact development where an alternating field is applied, the narrower the range between photoconductive material and the developing sleeve, the higher the developing property and the resolution. So, it is preferable that the range (i.e., developing gap) is 1 mm or less, more preferably 0.3 to 0.7 mm. It has been proven that it is impossible to keep the developer separate from photoconductive material by the use of a developer comprising carrier having particle diameters and magnetization strength used in the normal contact 2-component development. However, using a carrier which meets the above expressions and whose surface is provided with an insulating coating layer in accordance with the present invention provides excellent results. The present invention is further explained with reference to Examples:

EXAMPLE 1 (NORMAL DEVELOPMENT)

Preparation of Carrier

(i) Preparation of coating carrier

The surfaces of sphere-shaped copper-zinc ferrite grains whose mean diameters R (micro-meter) and magnetization strength (emu/cm$^3$) are different were coated with styreneacrylic resin by 1.5 micro-meters. Table 1 shows the obtained carriers. These coating carriers are used in Examples 1–8, and comparative Examples 1–5.

(ii) Preparation of distributed carrier 30 parts by weight of styrene-acrylic resin (Mw: 110,000, Mw/Mn=20) produced by Sekisui Chemical Co., Ltd. and 70 parts by weight of magnetite powder BL-100 produced by Titanium Kogyo Ltd. were mixed by a mixer. This mixture was kneaded fully by three rollers at a temperature of 140 degrees C., cooled, and pulverized by a hammer mill. Then, this crushed mixture was further pulverized by means of a jet mill, and classified to obtain a resin distributed carrier having an average particle diameter of 20 micro-meters. The carrier shall be a sample for comparison 6. Its strength of magnetization was 100 emu/cm$^3$.

On the other hand, a sample 7 whose characteristics are the same as of the sample 6 except for average particle diameter of 30 micro-meters was prepared. Its strength of magnetization was 100 emu/cm$^3$.

Preparation of toner 100 parts by weight of polyester resin 120p (produced by Kao Soap Co., Ltd.), 6 parts by weight of polypropylene 660p (produced by Sanyo Chemical Co., Ltd.), and 10 parts by weight of carbon black (Mogal L produced by Cabot Inc.) were mixed by a mixer, kneaded fully by three rollers at a temperature of 140 degrees C., cooled, and pulverized. This pulverized mixture was further pulverized by a jet mill and classified to obtain colorant particles whose average particle diameter is 11 micro-meters.

The 100 parts by weight of the colorant, 0.4 parts by weight of hydrophobic, fine-particle silica, R-812 (produced by Nihon Aerodil Ltd.), were added for distribution and mixing by a V-shaped mixer to prepare toner A.

The toner A was mixed with samples 1 thru 8 and samples for comparison 1 thru 7 to obtain developers a thru h and I thru O. To make constant the frictional charging conditions of toner and carrier, the toner concentration was set so that the ratio of the projected surface area of toner adherent on the carrier to the carrier surface area was 25 percent.

TABLE 1

| | Particle diameter R (μm) | Strength of magnetization M (emu/cm$^3$) | −0.8 R + 150 | Carrier | Developer |
|---|---|---|---|---|---|
| Sample 1 | 27 | 45 | 128 | Ferrite coating carrier | a |
| Sample 2 | 30 | 76 | 126 | Ferrite coating carrier | b |
| Sample 3 | 38 | 76 | 119.6 | Ferrite coating carrier | c |
| Sample 4 | 40 | 90 | 118 | Ferrite coating carrier | d |
| Sample 5 | 65 | 45 | 98 | Ferrite coating carrier | e |
| Sample 6 | 75 | 45 | 90 | Ferrite coating carrier | f |
| Sample 7 | 75 | 76 | 90 | Ferrite coating carrier | g |
| Sample 8 | 100 | 45 | 70 | Ferrite coating carrier | h |
| Sample for comparison 1 | 15 | 45 | 138 | Ferrite coating carrier | I |
| Sample for comparison 2 | 25 | 150 | 130 | Ferrite coating carrier | J |
| Sample for comparison 3 | 30 | 156 | 126 | Ferrite coating carrier | K |
| Sample for comparison 4 | 75 | 190 | 90 | Ferrite coating carrier | L |
| Sample for | 100 | 120 | 70 | Ferrite coating carrier | M |

TABLE 1-continued

| | Particle diameter R (μm) | Strength of magnetization M (emu/cm³) | −0.8 R + 150 | Carrier | Developer |
|---|---|---|---|---|---|
| comparison 5 | | | | | |
| Sample for comparison 6 | 20 | 100 | 134 | Distributed carrier | N |
| Sample for comparison 7 | 30 | 100 | 126 | Distributed carrier | O |

Figure 2:
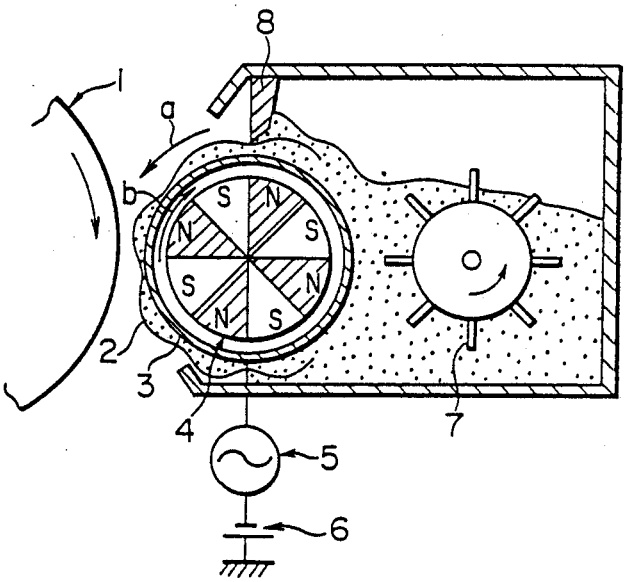

Experiment of duplication was performed using developers a thru h and I thru O by an electrophotographic copying machine (modified U-Bix 1600 manufactured by Konishiroku Photo Industry Co., Ltd.) equipped with a developing processor as shown in FIG. 2 to investigate toner chargeability, turf height of the magnetic brush, image resolution, image concentration, fogs, and carrier adhesion. As the photoconductive material, a drum with a selenium-tellurium photo-conductive layer was used.

A test of duplication was performed under environmental conditions of 20 degrees C. and 50 percent RH. The image concentration, resolution, carrier adhesion and fogs of resultant duplicated images were examined. The items except the image concentration were judged by visual inspection.

The charges of the developer were measured using a blow-off charge measuring instrument, TCB-200 (manufactured by Toshiba Chemical Co., Ltd.). If a carrier whose particle diameter is not more than 50 micrometers was used, a rare earth element magnet was installed in a measuring cell, because carrier particles were scattered by air blow.

The following are details of developing conditions:

Developing sleeve: aluminum pipe having a diameter of 24 mm

Developing sleeve revolution: 200 rpm

Developing sleeve revolution direction: Arrow direction a as shown in FIG. 2

Magnetic flux density on magnetic roller surface: 800 Gauss

Number of poles of magnetic roller: 8

Magnetic roller revolution: 1000 rpm

Magnetic roller revolution direction: Arrow direction b as shown in FIG. 2

Regulating gap of magnetic brush: 0.1 mm

Developing gap: 0.5 mm

Peripheral speed of selenium/tellurium: 142 mm per second

Potential of picture portion on electrostatic latent image: +700 volts

Potential of other than picture portion on electrostatic latent image: −100 volts Developing bias: AC voltage of 1 kVp-p having a frequency of 2 kHz superimposed on DC voltage of 200 volts Table 2 shows the summarized results, where the mark o signifies that neither carrier adhesion nor fog was observed and the mark x signifies that both were observed. (This also applies to Table 4.)

TABLE 2

| | Charges (μC/g) | Image concentration | Resolution (lines/mm) | Carrier adhesion | Fog |
|---|---|---|---|---|---|
| Developer a | −20 | 1.38 | 6.3 or more | o | o |
| Developer b | −19 | 1.41 | 6.3 or more | o | o |
| Developer c | −24 | 1.32 | 6.3 or more | o | o |
| Developer d | −17 | 1.43 | 6.3 or more | o | o |

TABLE 2-continued

| | Charges (μC/g) | Image concentration | Resolution (lines/mm) | Carrier adhesion | Fog |
|---|---|---|---|---|---|
| Developer e | −21 | 1.32 | 6.3 or more | o | o |
| Developer f | −21 | 1.31 | 6.3 or more | o | o |
| Developer g | −21 | 1.28 | 6.3 | o | o |
| Developer h | −23 | 1.18 | 6.3 | o | o |
| Developer I | −19 | 1.25 | 3 | x | o |
| Developer J | −21 | 0.75 | 4 | o | x |
| Developer K | −22 | 0.65 | 3 | o | x |
| Developer L | −21 | 0.52 | 3 | o | x |
| Developer M | −18 | 0.58 | 3 | o | x |
| Developer N | −3 | 1.22 | 6.3 | x | x |
| Developer O | −4 | 1.14 | 6.3 | x | o |

The developers a thru h that use the coating carrier disclosed by the present invention permit a magnetic brush separate from photoconductive material to be formed, providing high-resolution, high-concentration, duplicated images without any carrier adhesion and fog.

For the coating carrier used in the developer I, its particle diameter is small and the magnetic force operating on a carrier particle is low, resulting in adhesion of carrier particles on photoconductive material.

For the coating carrier used in developers J thru M, as its strength of magnetization M does not meet conditions of $M \leqq -0.8R+150$, turfs of the magnetic brush formed on the developing sleeve surface are tall, resulting in its contact with photoconductive material. In consequence, the resolution of duplicated images is lowered and developed toner is scratched by the magnetic brush, resulting in lowered image concentration.

For the distributed carrier used in developers N and O, the strength of magnetization M and the particle diameter R meet the relation of $M \leqq -0.8R+150$, while the toner is not charged fully, resulting in fogs. Further, as the carrier and the toner could not mixed sufficiently with each other, resulting in toner being scattered.

EXAMPLE 2 (REVERSAL DEVELOPMENT)

Presented first is a description of adhesion of developer onto the latent image-carrying member which occurs when reversal development is performed using a highly resistive coating carrier.

The structure of the latent image-carrying member (photoconductive material) used is such that a carrier generation layer 21 consisting of carrier generation material and phthalocyanine pigment is laid on a conductive substrate 22 and a carrier transport layer 20 is laid on the carrier generation layer 21.

The materials making up the respective layers are as follows:

Substrate: Aluminum

Carrier generation layer: τ-phthalocyanine distributed in polycarbonate resin

Carrier transport material: Mixture of the carbazole derivative having the following structure, and polycarbonate resin

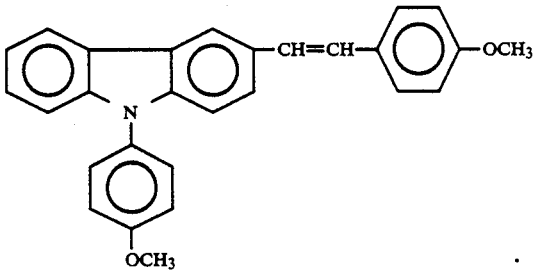

Figure 5:
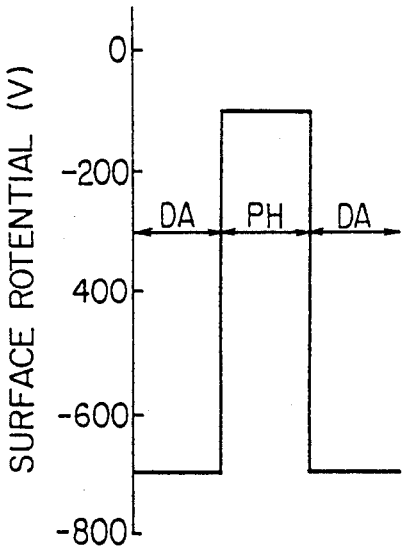

FIG. 5 shows sample surface potential of photoconductive material produced when the photoconductive material is exposed to laser beams to form electrostatic latent images. Prior to the exposure, the photoconductive material was charged to −700 volts by a charger.

While the surface potential of the portion DA not exposed to laser beams remains being −100 volts, that of the portion PH exposed to laser beams is −100 volts.

Figure 6:
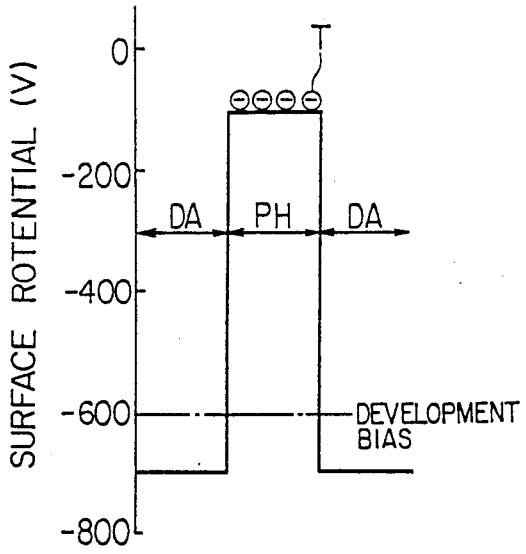
Figure 7:
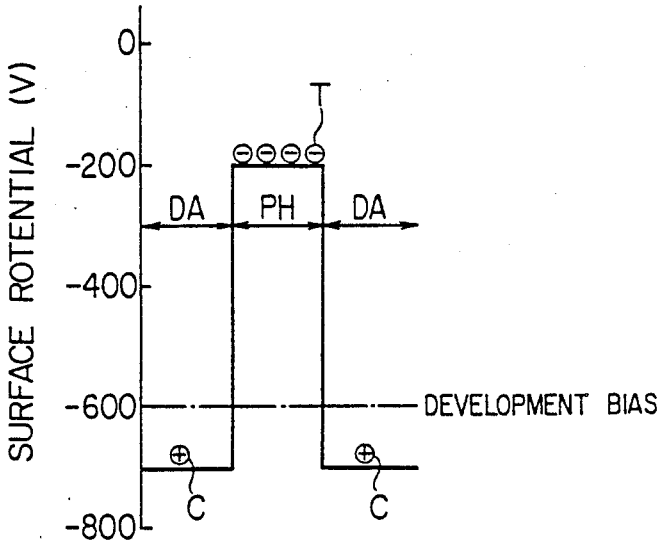
FIG. 7 is a graph which represents the surface potential of the latent image-carrying member and toner and carrier adhesion in the conventional reversal development; where 1 denotes the latent image-carrying member;
2 denotes the developer;
3 denotes the developer transporting member;
4 denotes a magnet roller;
5 denotes an AC power source;
6 denotes a DC power source;
7 denotes an agitating blade;
8 denotes the regulating blade;
10 denotes core material of a carrier particle;
15 denotes an insulating resin coating layer;
20 denotes a carrier transporting layer;
21 denotes a carrier generation layer;
22 denotes a conductive substrate;
T denotes toner;
C denotes a carrier;
PH denotes an exposed portion; and
DA denotes a non-exposed portion.

For reversal development, toner T negatively charged is caused to adhere onto the exposed portion PH with a developing bias of −600 volts applied. FIG. 6 shows the surface potential of the latent image-carrying member.

Since, as the carrier, a highly resistive coating carrier is used, no carrier particle adheres onto the non-exposed portion, and thus, no fog is produced.

Presented below is a concrete example of reversal development.

(o) Preparation of carrier

In the same manner as for the Example 1, carriers as shown in Table 3 (coating carriers for preferred embodiments 11 thru 18 and for examples for comparison 11 thru 15, and distributed carriers for examples for comparison 6 and 7) were prepared.

TABLE 3

| | Particle diameter (μm) | Strength of magnetization (emu/cm$^3$) | −0.8 R + 150 | Carrier | Developer |
|---|---|---|---|---|---|
| Sample 11 | 40 | 75 | 118 | Ferrite coating carrier | $a_2$ |
| Sample 12 | 80 | 75 | 86 | Ferrite coating carrier | $b_2$ |
| Sample 13 | 90 | 75 | 78 | Ferrite coating carrier | $c_2$ |
| Sample 14 | 20 | 85 | 134 | Ferrite coating carrier | $d_2$ |
| Sample 15 | 30 | 85 | 126 | Ferrite coating carrier | $e_2$ |
| Sample 16 | 20 | 100 | 134 | Ferrite coating carrier | $f_2$ |
| Sample 17 | 30 | 100 | 126 | Ferrite coating carrier | $g_2$ |
| Sample 18 | 40 | 100 | 118 | Ferrite coating carrier | $h_2$ |
| Sample for comparison 11 | 120 | 65 | 54 | Ferrite coating carrier | $I_2$ |
| Sample for comparison 12 | 140 | 65 | 38 | Ferrite coating carrier | $J_2$ |
| Sample for comparison 13 | 100 | 85 | 70 | Ferrite coating carrier | $K_2$ |
| Sample for comparison 14 | 120 | 85 | 54 | Ferrite coating carrier | $L_2$ |
| Sample for comparison 15 | 80 | 100 | 86 | Ferrite coating carrier | $M_2$ |
| Sample for comparison 6 | 20 | 100 | 134 | Distributed carrier | N |
| Sample for comparison 7 | 30 | 100 | 126 | Distributed carrier | O |

(o) Preparation of toner

Same toner as the toner A used in Example 1.

The toner A was mixed with samples 11 thru 18, samples for comparison 11 thru 15 and carriers 6 and 7 to obtain developers $a_2$, thru $h_2$, $I_2$ thru $M_2$, and N and O in the same manner as for the Example 1.

Figure 4:
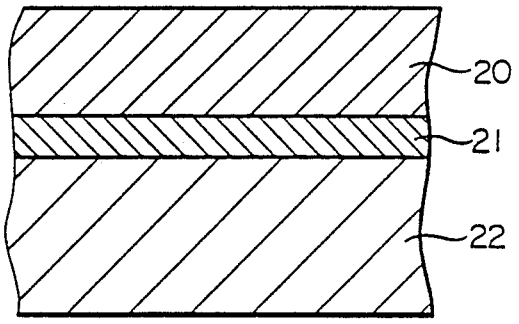

Using the above developers, reversal development test was performed by an electrophotographic copying machine (modified U-Bix 1200 manufactured by Konishiroku Photo Industry Co., Ltd.) equipped with a non-contact developing device. As the latent image-carrying member, negatively charged, OPC drum-like photoconductive material as shown in FIG. 4 was used. As the toner was charged negatively, the duplicating polarity of the copying machine was charged from negative to positive for use.

The following are details of developing conditions:

Developing sleeve: Aluminum pipe having a diameter of 24 mm

No. of developing sleeve revolutions: 200 rpm

Revolving direction of developing sleeve: Arrow a shown in FIG. 2

Magnetic flux density on magnetic roller surface: 800 gauss

No. of magnetic roller poles: 8

No. of magnetic roller revolutions: 100 rpm

Revolving direction of magnetic roller: Arrow b shown in FIG. 2.

Magnetic brush regulation gap: 0.1 mm

Developing gap: 0.5 mm

OPC drum peripheral speed: 80 mm/sec.

Potential of image portion on electrostatic image: −700 volts

Potential of other than image portion on electrostatic image: −100 volts

Developing bias: AC voltage with a frequency of 2 kHz (1 kVp-p, sine wave) superimposed on a DC voltage of −200 volts The duplication test was performed under environmental conditions of a temperature of 20 degrees C. and a relative humidity of 50 percent.

Table 4 shows the image concentration, resolution, toner charges, adherent carrier particles, and fogs of an obtained duplicated image. The charges of the developers were measured using a charge measuring instrument, TB-200, manufactured by Toshiba Chemical Co., Ltd.

TABLE 4

| Developer | Carrier used | Charges (μC/g) | Image concentration | Resolution (lines/mm) | Adherent carrier particles | Fog | Remarks |
|---|---|---|---|---|---|---|---|
| $a_2$ | 1 | 22 | 1.41 | 6.3 or more | o | o | Preferred |
| $b_2$ | 2 | 20 | 1.32 | 6.3 or more | o | o | embodiments |

TABLE 4-continued

| Developer | Carrier used | Charges (μC/g) | Image concentration | Resolution (lines/mm) | Adherent carrier particles | Fog | Remarks |
|---|---|---|---|---|---|---|---|
| $c_2$ | 3 | 24 | 1.36 | 6.3 or more | o | o | |
| $d_2$ | 4 | 18 | 1.40 | 6.3 or more | o | o | |
| $e_2$ | 5 | 22 | 1.35 | 6.3 or more | o | o | |
| $f_2$ | 6 | 23 | 1.30 | 6.3 or more | o | o | |
| $g_2$ | 7 | 24 | 1.32 | 6.3 or more | o | o | |
| $h_2$ | 8 | 23 | 1.31 | 6.3 or more | o | o | |
| $I_2$ | 9 | 19 | 0.8 | 3 | x | o | Examples for comparison |
| $J_2$ | 10 | 22 | 0.9 | 4 | o | o | |
| $K_2$ | 11 | 23 | 0.75 | 3 | o | o | |
| $L_2$ | 12 | 22 | 0.35 | 3 | o | o | |
| $M_2$. | 13 | 19 | 0.42 | 3 | o | o | |
| N | 14 | −4 | 1.12 | 6.3 or more | x | x | |
| O | 15 | −5 | 1.08 | 6.3 or more | x | x | |

The developers $a_2$ thru $h_2$ provide non-contact development with expressions of $30 \leqq M \leqq -0.8R+150$ met; so, no carrier adheres and no fog is produced, and thus, images having excellent image concentration and resolution were obtained. The developers $I_2$ thru $M_2$ do not meet the above expressions and their carrier particle diameter is greater. The latent image-carrying member and the magnetic brush are not kept being separated, the magnetic force operating on carrier particles forming the magnetic brush is weak, and the friction of the magnetic brush against the latent image-carrying member is weak. Thus, although no carrier particle adheres and no fog is produced except for the developer $I_2$, the black image is scratched, the resolution is low, and the carrier particles forming the magnetic brush adherent on the sleeve are sparse, resulting in insufficient development. In addition, toner used for development tends to be scratched and high image concentration is not obtained.

On the other hand, for developers N and O that use distributed carriers, enough image concentration is obtained, but the magnetic force is somewhat weak and the electric resistance of the carrier is low. In consequence, positive charges are induced on the carrier due to electrostatic induction, resulting in carrier adhesion.

As characteristics of frictional charges produced through mixing with toner are inferior to those of the coating carrier, the toner was charged less, and thus, fogs were observed on duplicated images. Also, insufficiently charged toner was scattered and the periphery around the developing processor was dirty.

The above examples cover mono-color image forming. But the present invention can also be applied to a multi-color image forming method which forms electrostatic latent images by color element for development and forms full-color images through their composition.

The developer may contain the above coating carrier and toner, as well as abrasive materials such as $CeO_2$, SiC, $SiO_2$ and/or $Al_2O_3$ to ensure sensitized material cleaning, and/or lubricants such as zinc stearate.

Further, the above preferred embodiments can be changed on the basis of the technological philosophy of the present invention. For example, developing conditions may be changed variously. In addition, the materials of carriers used, types of coating resin, and coating methods are not limited to the above mentioned materials, types and methods, respectively.

What is claimed is:

1. In a method of developing an electrostatic latent image formed on an electrostatic latent image-carrying member with a developer comprising a magnetic carrier and a toner in a non-contact manner under application of an oscillating electric field to a development region, the improvement comprising the surface of said magnetic carrier is covered with an insulating material, and magnetization (M) of said magnetic carrier when measured under application of a magnetic field of 1000 Oersted and weight average diameter (R) of the same expressed in terms of micro meter satisfy the following relation:

$$30 \leqq M \leqq -0.8R+150$$

(wherein $10 \leqq R \leqq 150$).

2. The method of claim 1, wherein said oscillating electric field is generated by an alternating electric current.

3. The method of claim 2, wherein said alternating current has 0.2 to 3.0 kV at a frequency of 100 Hz to 10 kHz.

4. The method of claim 2, wherein said alternating current has 0.2 to 3.0 kV at a frequency of 0.2 to 3.0 kHz.

5. The method of claim 1 wherein $20 \leqq R \leqq 60$.

6. The method of claim 1, wherein $40 \leqq M \leqq 100$ emu/cm$^2$.

7. The method of claim 5, wherein $40 \leqq M \leqq 100$.

8. A method of developing an electrostatic latent image formed on an electrostatic latent image-carrying member with a developer comprising a magnetic carrier and a toner, said method comprising a step of supplying said developer on the surface of a developer transporting member being provided opposite to said electrostatic latent image-carrying member at a predetermined distance and comprising a non-magnetic sleeve member and a magnetic member, said sleeve member and said magnetic member being arranged so as to be movable relative to each other, a step of forming a thin layer of said developer on the surface of said sleeve member so that the maximum thickness of the layer in a region at which development takes place is smaller than said predetermined distance and transporting said developer to said region, and a step of developing an electrostatic latent image on said image-carrying member with said toner under application of an oscillating electric field to said region, wherein said magnetic carrier consisting of magnetic particles of which surfaces are covered with an insulating material, and magnetization (M) of said magnetic carrier when measured under application of a magnetic field of 1000 Oersted and weight average diameter (R) expressed in terms of micro meter satisfy the following relation:

$$30 \leqq M \leqq -0.8R + 150$$

(wherein $10 \leqq R3$ 150).

9. The method of claim 8, wherein said sleeve member is of a cylindrical shape and said magnet member is provided therein.

10. The method of claim 9, wherein said oscillating electric field is generated by a alternating electric current.

11. The method of claim 10, wherein said alternating current has 0.2 to 3.0 kV at a frequency of 100 kHz to 10 kHz.

12. The method of claim 10, wherein said alternating current has 0.2 to 3.0 kV at a frequency of 0.2 to 3.0 kHz.

13. The method of claim 9, wherein $20 \leqq R \leqq 60$.

14. The method of claim 9, wherein $40 \leqq M \leqq 100$ emu/cm$^2$.

15. The method of claim 13, wherein $40 \leqq M \leqq 100$.

16. A developer for electrophotography comprising a magnetic carrier and an electroscopic toner, characterized in that said carrier comprises a magnetic material, that the surface of said carrier is covered with an insulating material, and that magnetization (M) of said magnetic carrier when measured under application of a magnetic field of 1000 Oersted and weight average diameter (R) expressed in terms of micro meter satisfy the following relation:

$$30 \leqq M \leqq -0.8R + 150$$

(wherein $10 \leqq R \leqq 150$).

17. The developer of claim 16, wherein said magnetic material is selected from the group consisting of iron, nickel, cobalt, an alloy thereof and an magnetic metal oxide.

18. The developer of claim 16, wherein said magnetic material is a ferrite having an electric resistance of $10^8$ to $10^{12}$ Ω·cm.

19. The developer of claim 16, wherein said insulating material is selected from an insulating resin.

20. The developer of claim 19, wherein said resin is selected from the group consisting of a styrene-acrylic resin, a siliconic resin, a fluorinated resin, an acrylic resin, a polyester resin, an epoxy resin, a vinyl chloride resin, a vinyl acetate resin a vinyl chloride-vinyl acetate copolymer and a nitrogen-containing resin.

* * * * *